United States Patent [19]

Sandham

[11] 3,934,930

[45] Jan. 27, 1976

[54] BACK SUPPORT FOR CHAIR

[75] Inventor: Edwin C. Sandham, Thiensville, Wis.

[73] Assignee: Leggett & Platt, Incorporated, Carthage, Mo.

[22] Filed: Nov. 7, 1974

[21] Appl. No.: 521,940

[52] U.S. Cl. ..... 297/291; 403/326

[51] Int. Cl.[2] ..... A47C 7/44

[58] Field of Search ..... 297/291, 299, 296–298, 297/300, 306; 248/374, 375; 24/201 C, 201 S; 403/326, 6, 9

[56] References Cited

UNITED STATES PATENTS

| | | | |
|---|---|---|---|
| 189,933 | 4/1877 | Geise | 248/375 |
| 1,566,026 | 12/1925 | Leipert | 248/375 X |
| 2,083,071 | 6/1937 | Lewis | 297/291 |
| 2,529,683 | 11/1950 | Fox | 297/291 |
| 2,796,920 | 6/1957 | Cowles | 297/291 |
| 2,847,062 | 8/1958 | Henrikson | 297/306 |
| 2,921,607 | 1/1960 | Caveney | 24/201 C |

*Primary Examiner*—Francis K. Zugel

*Attorney, Agent, or Firm*—Wood, Herron & Evans

[57] ABSTRACT

A back support for a chair having a seat and a back pad. The support includes an elongated support member attached at one end to the chair seat and at its other end to the back pad. The back pad attachment includes a flexible block attached to the back pad with a clip disposed in part between the block and the pad. The clip includes top and bottom portions disposed on either side of the block with one of the portions including a lip along one edge thereof. The block and the clip are forced into a pocket on the support member. The pocket includes a slot to receive the lip thereby securing the back pad to the support member. The flexing of the block permits the back pad to pivot thereby adjusting the back pad position to the contour of the back of a person seated on the chair.

9 Claims, 7 Drawing Figures

BACK SUPPORT FOR CHAIR

BACKGROUND OF THE INVENTION

The invention relates generally to the field of chairs and more particularly to a back support for a swivel chair.

Characteristically, swivel chairs include a base to which a seat is swivel mounted. Extending upwardly from the seat is a back support which generally includes a back pad mounted at the upper end of the back support. Normally, the back pad is pivotally mounted to the support member so that its position will adjust to the contour of the back of a person seated on the chair.

Many chairs, and particularly swivel chairs, are commonly shipped in a "knock-down" or disassembled condition so as to minimize shipping costs. Consequently, assembly of the chair devolves upon the retailer or the ultimate customer. In either event, assembly should be a very simple, easy task accomplished with a minimum of power or hand tools.

Most swivel chairs include pivotal mountings between the chair back pad and an elongated back support member to which the back pad is mounted. Typically, these pivotal mountings are complex and difficult for an unskilled customer or retailer to assemble and consequently, many swivel chairs are shipped with the back pad and back support in an assembled condition. This manner of shipment is not optimal since it wastes shipping space, but it avoids having customers assemble complex pivotal assemblies.

It has therefore been an objective of the present invention to provide a pivotally interconnectable chair back support and back pad of simple design permitting the two back sections of the chair to be shipped in "knock-down" condition and easily assembled by the customer.

It is a further objective of the invention to provide an easily assembled chair back support having a silent cushioned pivotal movement between the back pad and a support member thereby providing maximum comfort in combination with an easily assembled structure.

It is a further objective of the invention to provide a back support for a swivel chair wherein the pivotal connection between the back pad and the support member has all its movable parts completely enclosed, thereby enhancing the appearance of the chair.

It is still a furhter objective of the invention to provide a back support for a swivel chair that can be disassembled if necessary with the use of simple hand tools.

BRIEF DESCRIPTION

The invention is predicated in part on the concept of providing a back support for a chair having a resilient connection between a back pad and a vertical back support bar or post. The connection between the two is such that the two may be shipped separately but joined together or assembled in the field without the use of any tools by a simple snap fit interconnection.

More specifically, the back support comprises a conventional vertical back support bar or post adapted to be attached at its lower end to the chair seat. At its upper end the back support post has a recess or pocket for receiving a resilient snap fit connector secured to the back pad. The snap fit attachment includes a flexible block of rubber which is secured to the back side of the back pad. A clip is disposed between the flexible block and the back pad. The clip includes two side portions which are disposed on opposite sides of the block. One of the side portions includes a lip adapted to be snap fit into a slot at the back of the recess or pocket of the vertical post. When the rubber block and clip are received into the pocket and the lip of the clip snapped into the slot at the rear of the pocket, the connection is such that the lip and slot are resiliently retained in engagement by the rubber block and cooperate to flexibly retain the back pad on the support member.

Since the block is made of a flexible material, the back pad can pivot on the back support about the longitudinal axis through the block which is generally parallel to the longitudinal axis of the lip. The flexing action of the block permits the back pad to be self adjusting to conform to the contour of the back on a person seated on the chair.

BRIEF DESCRIPTION OF THE DRAWINGS

The foregoing objects and features of the invention will become more clear from the following detailed description of a preferred embodiment of the invention taken in connection with the drawings which form a part of the original disclosure wherein.

DETAILED DESCRIPTION

Figure 1:
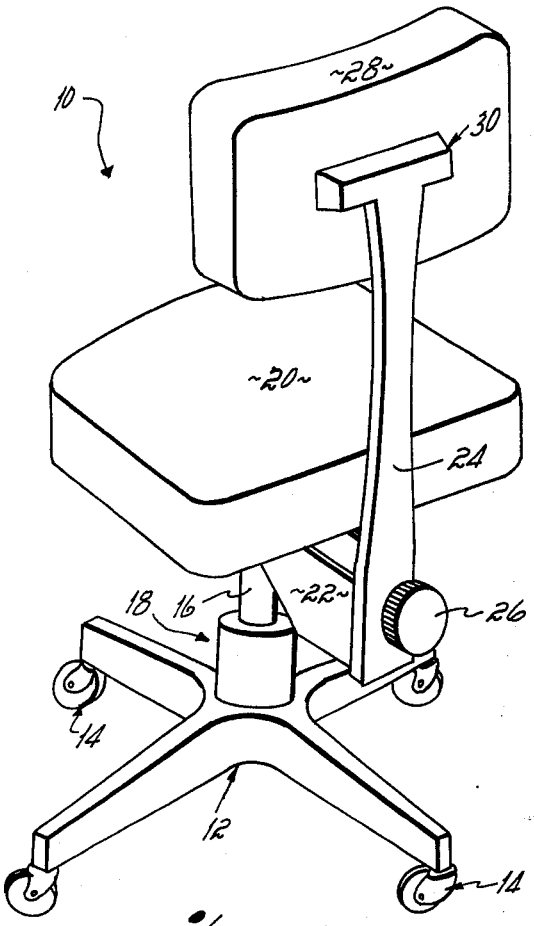
FIG. 1 is a perspective view of a swivel chair including the back support of the present invention.

Referring now to FIG. 1, a typical swivel chair is shown generally at 10. The chair includes a base 12 having a plurality of casters 14 mounted thereon to permit free rolling of the base 12 on a support surface. A vertical support member 16 extends upwardly from the base 12 and is rotatably mounted, as shown generally at 18, to the base 12 permitting the support member 16 to freely rotate about a vertical axis therethrough.

Mounted at the upper end of the support member 16 is a chair seat 20 which is preferably padded for the comfort of the person seated on the chair. Extending rearwardly from underneath the chair seat 20 is a support bracket 22 which is connected either to the bottom of the seat 20 or to the vertical support member 16 in a manner well known to the swivel chair art. Typically, however, the bracket 22 has a threaded screw (not shown), which extends rearwardly from the bracket 22 and passes through a slot or hole in a vertical back support post 24. The post is conventionally secured to the bracket 22 by a clamp nut 26.

Disposed at the upper end of the elongated support member 24 is a back pad 28. The back pad 28 preferably includes padding for comfortably contacting the back of a person seated on the chair. The back pad 28 is pivotally connected at a point shown generally at 30 to the support member 24 in a manner which will be described hereinafter in greater detail.

Figure 2:
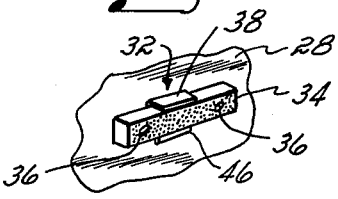
FIG. 2 is a fragmentary perspective view of the chair back pad showing the pivotal connection mounted thereon.
Figure 7:
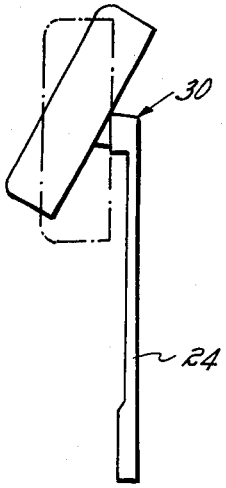
FIG. 7 shows diagrammatically the pivoting of the back pad on the support member.

Referring now to FIG. 2, the back pad 28 is shown disassembled from the support post 24. The chair typically is shipped from the factory in this condition and, in a manner which will become clear hereinafter, subsequently assembled at the customer location.

Centrally located on the back side of the back pad 28 is a snap fit connector or attachment shown generally at 32. The connector 32 includes an elongated resilient rubber block 34 which is secured to the pad 28 by screws 36 which extend through the block 34 into the back side of the back pad 28. Located between the screws 36 and between the flexible block 34 and the back of the back pad 28 is a generally U-shaped clip 38.

Figure 6:
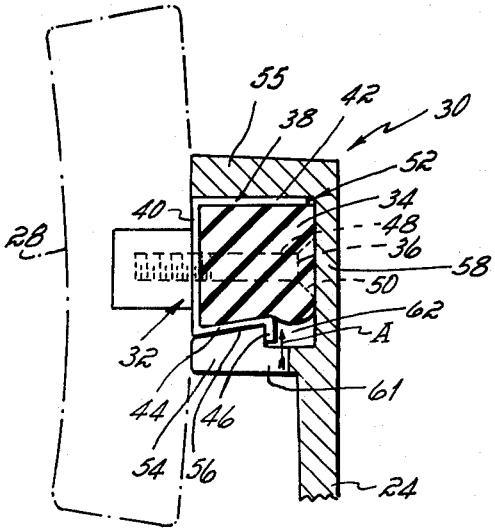
FIG. 6 is a longitudinal sectional view taken through the vertical support post and the back pad wherein the back pad is attached to the support post.
Figure 3:
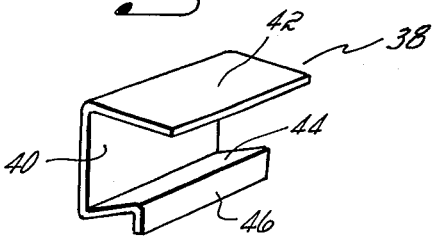
FIG. 3 is a perspective view of the clip which forms part of the pivotal connection.

The clip 38, as better viewed in FIG. 3, is preferably made of a thin flexible metal sheet formed to include a central portion or web 40 which, as viewed in FIGS. 2 and 6, is disposed between the flexible block 34 and the backside of the back pad 28. The clip 38 comprises a generally rectangular shaped planar central portion having side portions 42 and 44 extending generally in a perpendicular direction to the central portion 40. Since the clip 38 is preferably made of sheet metal, the side portions 42 and 44 comprise extensions of the central portion 40 bent to form an angle of approximately 90° between the side portions 42 and 44 and the central portion 40. In addition, a lip 46 is formed at one edge of the side portion 44 by bending the side portion 44 downwardly thereby forming a lip 46 lying in a plane parallel to the plane of the central portion 40. The lip 46, as will become more apparent later, aids in securing the back pad 28 to the support member 24.

Figure 4:
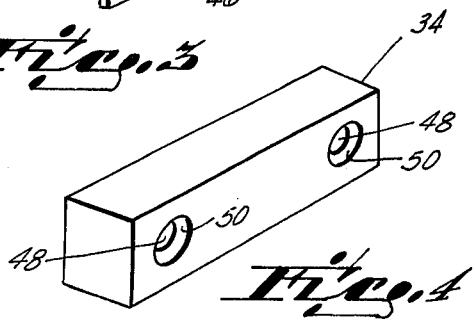
FIG. 4 is a perspective view of the flexible block which forms part of the pivotal connection.

Referring now to FIG. 4, the flexible block 34 is shown in greater detail. As indicated generally above, the flexible block 34 comprises an elongated rectangular cross section flexible material such as rubber or the like. Holes 48 extend through the block 34 in a direction substantially perpendicular to the longitudinal axis. These holes 48 provide a passageway for the screws 36 which attach the block 34 to the back side of the back pad 28. The holes 48 are preferably located near opposite ends of the block 34 thereby permitting the clip 38 to be disposed between the screws 36 when the block 34 is attached to the back pad 28. Preferably, the holes are countersunk as indicated at 50 for the reception of the head of each screw 36.

Figure 5:
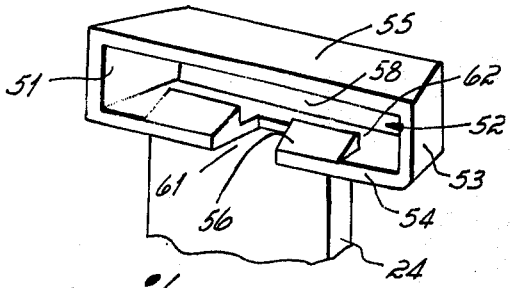
FIG. 5 is a perspective view of the pocket formed at the upper end of the vertical support post.

As viewed in FIG. 1, the upper end of the vertical post 24 comprises a substantially T-shaped section. As viewed in FIG. 5, the horizontally disposed portion of the T-shaped section has a pocket or recess, shown generally at 52, formed therein which is sized and shaped so as to facilitate reception of the snap fit connector 32 into the pocket 52. The pocket 52 is formed by a substantially rectangular shaped entrance from which extend side walls 51, 53, a top wall 55, and a bottom wall 54. Disposed along the bottom wall 54 of the pocket 52 is an upwardly and inwardly sloping cam surface 56 which terminates short of the wall 58 so as to define a slot 62 at the lower back corner of the recess. This slot is adapted to receive the lip 46 of the clip 38 when the back pad 28 is attached to the support member 24.

Securement of the back pad 28 to the vertical support post 24 requires only that the snap fit connector or attachment 32 be aligned and forced into the pocket 52 by hand. As the attachment 32 is forced into the pocket 52, the lip 46 is displaced upwardly, as viewed in FIG. 6 by the cam surface 56. Once the lip 46 passes beyond the cam surface 56 of wall 54, the force of the flexible block 34 on the side portion 44 will force or snap the lip 46 downwardly into the slot 62 to the position shown in FIG. 6. In this position, the back pad is permanently secured to the post.

In order to facilitate removal of back pad 28 from the vertical post, slot 61 is formed in the bottom 54 of the front face of the T shaped section of the post 24. This slot 61 extends rearwardly from the front fact to a depth whereby it intersects the rear slot 62 of the pocket 52.

If, for some reason, it is desired to remove the back pad 28 from the support member 24, removal is possible with a tool such as a screwdriver. The blade end of the screwdriver is forced upwardly through the slot 61 to engage the lip 46. By forcing the lip in an upward direction as defined by the arrow labeled A in FIG. 6, the lip 46 can be displaced upwardly out of engagement with the bottom wall 54 thereby permitting the back pad 28 and the attached snap fit connector 32 to be withdrawn from the pocket 52. As such, the back support of the present invention permits attachment of the back pad 28 to the support member 24 without requiring any tools and removal of the back pad 28 from the support 24 can be accomplished with only a simple screwdriver.

By reason of the above described attachment mechanism for attaching a back pad 28 to a support member 24, the movable parts of the attachment means 32 are completely enclosed by the pocket 52 thereby enhancing the chair appearance because of this concealment. Furthermore, since the pivotal connection is provided by a flexible block 34, lubrication of this pivotal connection is not required. Should the attachment means 32 require maintenance, however, maintenance can be performed at the customer location with simple hand tools.

While the foregoing description has been made with particular emphasis on a preferred embodiment of the invention, it will be recognized by those skilled in the art that many modifications in form only may be made without departing from the spirit and scope of the invention as defined by the following claims.

What is claimed is:

1. A back support for a chair which includes a back pad comprising, in combination:
   - an elongated resilient block attached to the back pad;
   - a clip in part disposed between said block and said back pad;
   - a locking element integrally formed on said clip,
   - a support member including a pocket disposed therein, said pocket being shaped to receive said block and said clip, a portion of said pocket cooperating with said locking element of said clip when said block and clip are inserted therein to resiliently urge said locking element to a locked position wherein the back pad is connected to said support member for pivotal movement relative thereto.

2. The back support of claim 1 in which said locking element comprises an outwardly extending lip disposed along one edge of said clip, a slot disposed inside said pocket, said lip being resiliently urged into said slot when said block and said clip are received by said pocket to attach the back pad to said support member.

3. The back support of claim 2, additionally including an opening through said support member into said pocket so that a tool can be inserted therethrough to engage said clip and disconnect the back pad from said support member.

4. A back support for a chair which includes a seat and a back pad comprising, in combination:

an elongated flexible block attached at opposite ends thereof to the back pad, a generally U-shaped clip with a central portion and two side portions disposed on opposite edges of said central portion, said central portion of said clip being disposed between said flexible block and the back pad, and said two side portions being disposed with said flexible block therebetween, at least one said side portion including a lip disposed along one edge thereof; and an elongated support member adapted to be attached at one end to the chair seat and including a pocket located at the opposite end of said support member from the attachment point to the chair seat, said pocket being shaped to receive said flexible block and said clip, said pocket including an interiorly disposed slot for receiving said lip when said flexible block and said clip are received by said pocket, the retaining action of said lip received by said slot being operative to attach the back pad to said elongated support with the flexing action of said flexible block permitting the back pad to pivot on said elongated member to adjust the back pad position to the contour of the back of a person seated on the chair.

5. The back support of claim 4 wherein said flexible block is made of a hard rubber material.

6. The back support of claim 4 wherein said clip is made of a metal sheet.

7. The back support of claim 4 wherein said pocket includes at least one inwardly sloping cam, said cam sloping inwardly from the entrance to said pocket, said cam having a rear surface which comprises part of said slot for receiving said lip.

8. The back support of claim 4 additionally including an opening through said pocket for exposing said lip when received in said slot, said opening being adapted to receive a tool for forcing said lip out of said slot to permit removal of the back pad from said support member.

9. A back support for a chair which includes a vertical support member and a back pad, a snap fit connector for securing said back pad to said vertical support member, said connector including an elongated resilient block attached to the back pad, a clip of unitary construction with a central planar portion and two side portions extending from opposite edges of said central portion, said central portion being disposed between said block and the back pad, at least one side portion of said clip including a lip integrally formed therewith, said vertical support member including an open pocket for receiving said block and said clip, said pocket including a slot into which said lip is resiliently urged by said resilient block when said block and clip are fully received by said pocket.

* * * * *